US011514758B2

(12) United States Patent
Meckenzie et al.

(10) Patent No.: US 11,514,758 B2
(45) Date of Patent: Nov. 29, 2022

(54) SYSTEM AND METHOD FOR PROVIDING ONLINE PULSE BETTING ON A GAME OR SPORTS EVENT

(71) Applicant: SBTech (Global) Limited, Douglas (GB)

(72) Inventors: Shalom Meckenzie, Rishon LeZion (IL); Ian Bradley, Douglas (GB); Gregory Karaolis, Douglas (GB)

(73) Assignee: SBTech (Global) Limited, Douglas (GB)

( * ) Notice: Subject to any disclaimer, the term of this patent is extended or adjusted under 35 U.S.C. 154(b) by 6 days.

(21) Appl. No.: 16/967,378

(22) PCT Filed: Feb. 5, 2019

(86) PCT No.: PCT/IL2019/050138

§ 371 (c)(1),
(2) Date: Aug. 4, 2020

(87) PCT Pub. No.: WO2019/150380

PCT Pub. Date: Aug. 8, 2019

(65) Prior Publication Data

US 2020/0394876 A1 Dec. 17, 2020

Related U.S. Application Data

(60) Provisional application No. 62/626,166, filed on Feb. 5, 2018.

(51) Int. Cl.
*G07F 17/32* (2006.01)

(52) U.S. Cl.
CPC ..... *G07F 17/3288* (2013.01); *G07F 17/323* (2013.01); *G07F 17/3209* (2013.01);
(Continued)

(58) Field of Classification Search
CPC ..... G07F 17/3288; G07F 17/3209; G07F 17/3213; G07F 17/3227; G07F 17/323; G07F 17/3262; G07F 17/32; G06Q 50/34
See application file for complete search history.

(56) References Cited

U.S. PATENT DOCUMENTS 5,354,069 A * 10/1994 Guttman ..... G07C 15/006 273/269
5,823,879 A * 10/1998 Goldberg ..... H04N 21/252 463/42

(Continued)

FOREIGN PATENT DOCUMENTS

EP 3749425 A1 12/2020
WO 2013132293 A1 9/2013

(Continued)

OTHER PUBLICATIONS

Canadian Intellectual Property Office—Office Action for Canadian Application No. 3,101,515, dated Jan. 29, 2021, 4pp.

(Continued)

*Primary Examiner* — Kevin Y Kim
(74) *Attorney, Agent, or Firm* — The Roy Gross Law Firm, LLC; Roy Gross

(57) ABSTRACT

A system and method is provided for enabling an online user to place bets concerning incidents occurring during a game or sports event. This is done by providing a portal for a user to place a bet predicated on a defined incident occurring during a predetermined time segment of the event. The platform includes a module for calculating odds and prize returns for said incident to occur during said sports event or game in response to a user request, a GUI presentation and a settlement engine.

12 Claims, 5 Drawing Sheets

(52) U.S. Cl.
CPC ..... *G07F 17/3213* (2013.01); *G07F 17/3227* (2013.01); *G07F 17/3262* (2013.01)

(56) References Cited

U.S. PATENT DOCUMENTS

| | | | | |
|---|---|---|---|---|
| 2006/0258438 | A1* | 11/2006 | Platis | G07F 17/32 463/25 |
| 2010/0105464 | A1 | 4/2010 | Storm et al. | |
| 2012/0100918 | A1 | 4/2012 | Ginsberg et al. | |
| 2012/0214575 | A1 | 8/2012 | Amaitis et al. | |
| 2016/0300451 | A1 | 10/2016 | Arbel | |
| 2020/0394876 | A1 | 12/2020 | Meckenzie et al. | |

FOREIGN PATENT DOCUMENTS

| | | | |
|---|---|---|---|
| WO | 2016110797 | A1 | 7/2016 |
| WO | 2019150380 | A1 | 8/2019 |

OTHER PUBLICATIONS

IP Australia Examination Report No. 1 for Australian Application No. 2019213846, dated Oct. 21, 2020, 5pp.
IP Australia Examination Report No. 2 for Australian Application No. 2019213846, dated Jun. 11, 2021, 4pp.
International Preliminary Report on Patentability for International Application No. PCT/IL2019/050138, completed Jun. 7, 2020, 14pp.
Supplementary European Search Report for European Application No. EP19746914, completed Oct. 4, 2021, 2pp.
PCT International Search Report for International Application No. PCT/IL2019/050138, dated Apr. 18, 2019, 3pp.
PCT Written Opinion for International Application No. PCT/IL2019/050138, 4pp.

* cited by examiner

SYSTEM AND METHOD FOR PROVIDING ONLINE PULSE BETTING ON A GAME OR SPORTS EVENT

PRIORITY

This application is a U.S. national application of the international application number PCT/IL2019/050138 filed on Feb. 5, 2019, which claims priority of U.S. provisional application 62/626,166 filed on Feb. 5, 2018, the contents of which are incorporated herein by reference.

BACKGROUND

Betting and gaming is a multimillion dollar international activity where online methods and systems have an increasing share of the industry.

Improvements in the industry are constantly being sought, in order to provide better opportunities for new gamblers and veterans alike. One of the long felt unmet needs in the betting industry is for a user to have the ability to closely control their activities while betting.

SUMMARY

Embodiments of the present invention provide a system for providing online pulse betting on a game or sports event. The system comprises a. a betting portal for a user to enter bet selections concerning defined incidents in a game occurring at predefined time segments
b. a calculation module for calculating winning amounts
c. a web application for receiving, and validating said bets
d. an incident feed
e. database for recording and storing said bet
f. a settlement engine for settling said bet The aforementioned web application is interconnected to the incident feed for the incident, the calculation module is interconnected to the web application and is configured to calculate winning amounts in predetermined periods of the bet. The information is presented on a GUI provided with a widget, and a settlement engine comprises connectivity to the calculation module, the web application, and the widget. The settlement engine is configured to settle the bet through the aforementioned widget.

Aspects of the present invention disclose herein a betting method for enabling an online user to place bets concerning incidents occurring during a game or sports event by providing a portal for a user to place a bet. The bet is predicated on a defined incident occurring during a predetermined time segment of the game or sports event, and the method comprises the following steps:

calculating odds and prize returns for the incident to occur during the sports event or game in response to a user request offering the user betting odds by means of a display on a GUI. The GUI display comprises event title, stake amount, time segments and countdown.

The present method further enables validation steps for validating the placed bet and settling the bet by means of a settlement engine.

DETAILED DESCRIPTION OF THE DRAWINGS

Figure 1:
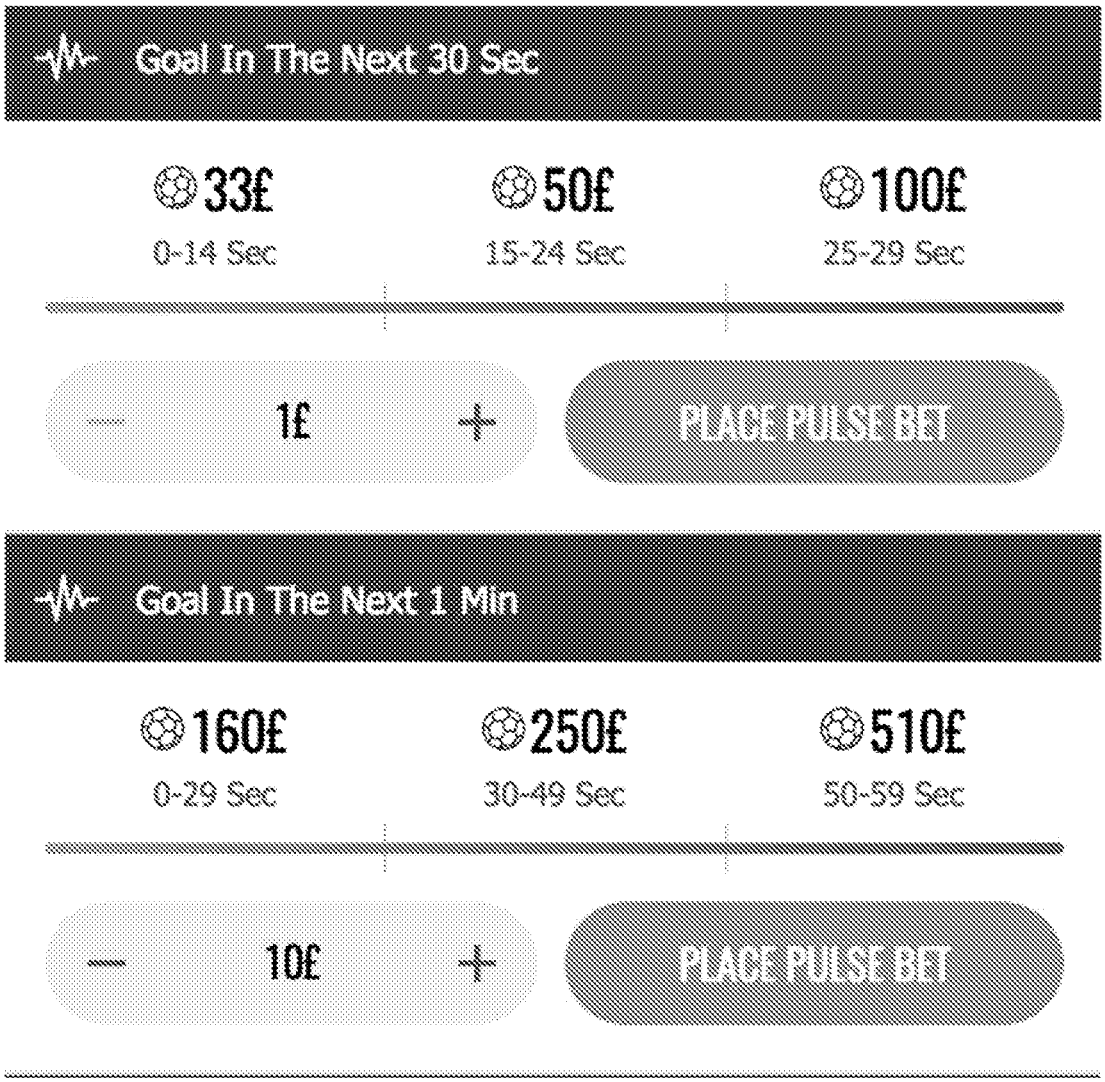
FIG. 1. is a schematic illustration of information provided to the user on the GUI of the present invention.

In the following description, various aspects of the invention will be described. For the purposes of explanation, specific details are set forth in order to provide a thorough understanding of the invention. It will be apparent to one skilled in the art that there are other embodiments of the invention that differ in details without affecting the essential nature thereof. The invention is not limited by that which is illustrated in the figure and described in the specification, but only as indicated in the accompanying claims, with the proper scope determined only by the broadest interpretation of said claims.

A revolutionary new betting method is herein provided putting the user in control.

In the present invention, the user is enable to finely control the following activities:

The user can bet on demand, whenever desired during the course of the event.

The user is provided with means to control duration of their bet (duration being defined as the length of time that the user's stake is at risk).

The user is provided with means to correlate the stake with the potential returns.

It is herein acknowledged that this novel method provides methods smart pricing algorithms, to generate bet prices and thereby enables custom bet placement and settlement micro services to power the gamified betting experience in real-time.

It is a feature of the present invention that means and methods are provided for real-time settlement. It is well known that rapid settlement of bets allows the user to receive instant gratification based on the relevant incident coming from the feed.

It is a feature of the present invention that a calculation service dynamically calculates the tiered winning amounts based on the user selections It is a feature of the present invention for the web application or widget widget to run validations across prices, funds. and then call the betting microservice to confirm the bet.

It is a feature of the present invention that validations are run on the backend and a response is sent to the web application to begin running the animation showing the bet progress while asynchronously placing the bet in the database.

Characterization of the Method:

The operator defines the periods/durations and the returns per period/duration. The operator selects where the jackpot period is, early, middle or late. The winnings are not fixed unlike traditional sports betting which has a fixed stake and fixed return. "Pulse" betting has a fixed stake but variable returns, for example a "Jackpot" return in the last 10 seconds of the bet. A £1 stake, will let you win either £32, £49 or a Jackpot of £98 for the last ten seconds. It is herein acknowledged that embodiments of the present invention are applicable to spot betting as well as pulse betting.

The method of the present invention is disclosed herein: The user selects and initiates the period of the bet, for example (30 sec, 1 min, 5 min, 10 min).

The implementation algorithm of the method is configured such that the user has a fixed loss amount yet multiple winning amounts based on events and instances occurring during the period of the bet The algorithm is configured such that the winnings can be exponentially bigger than their stake.

The algorithm of the present invention is configured to provide the user with a "Jackpot" period. For example, in a soccer match, if the goal happens during the "Jackpot" period an enhanced return will be provided compared to the stake.

The aforementioned method is implemented by technologies comprising a. Pricing algorithm b. bet placement process module to allow bet periods to be dynamic with a GUI presenting a widget.

c. Settlement engine to be able to process the multiple winning amounts

Overall Description of the Method:

The User enters the online portal and selects an event and a stake. The user is presented on the GUI with a return on a bet for goals to happen in the period. A countdown then ensues. The user may start the bet whenever they choose throughout the period of the match.

The calculation module calculates the winning amounts based on the user selections.

The calculation module accepts or rejects the bet according to preconfigured parameters and if the bet is accepted the GUI provides information on the progress of the game, the conditions of the bet, returns on the bet and provides opportunities for the bet to be purposed to a different time segment. At the conclusion of the predetermined game or betted event, the settlement engine enables payment.

The calculation module uses inputs from incident feeds (be that just time decay or any relevant sporting incident) to dynamically calculate the probabilities of an event happening within a defined time period.

The web application of the present invention initially validates the bets on the client side before validating against the core calculations in the front.

FIG. 1 is a schematic representation of the GUI showing information to the user comprising;

The bet (goal in the next 30 seconds)

The prize: (33 GBP FIG. 2/5 if goal scored in 0-14 secs, 50 GBP if goal scored in 15-24 Secs. 100 GBP if goal scored in 25-29 Secs. etc.).

The stake (1 GBP)

Figure 2:
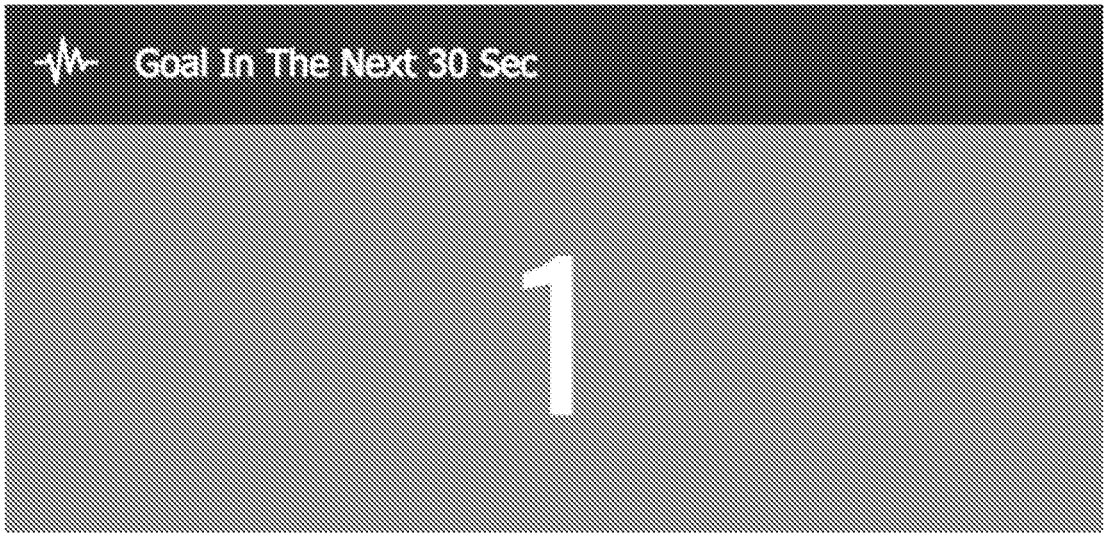
FIG. 2 is a schematic illustration of information provided to the user on the GUI of the present invention.
Figure 2:
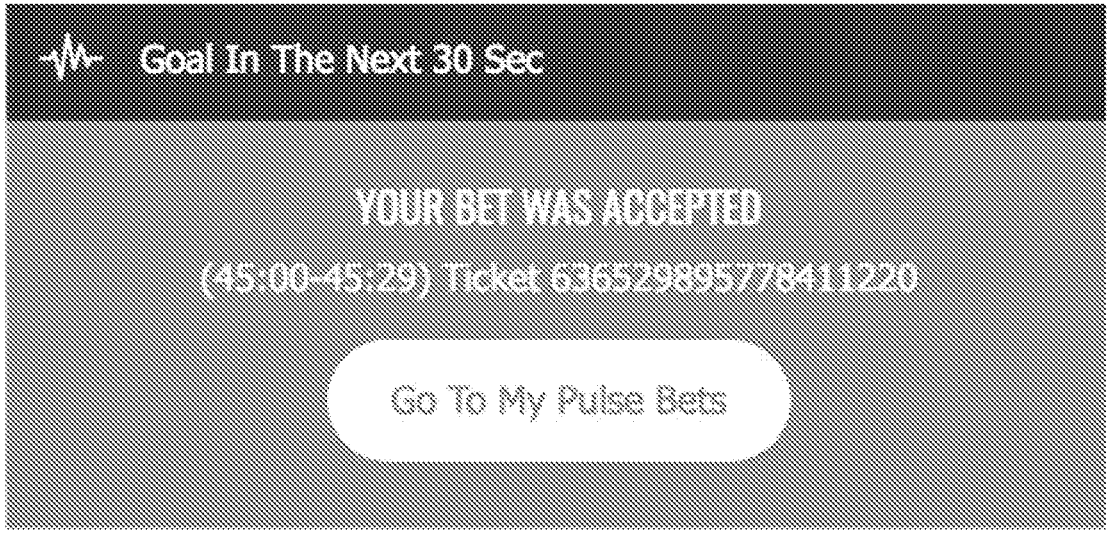

FIG. 2. is a schematic representation of the GUI showing information to the user comprising the acceptance of the bet.

Figure 3:
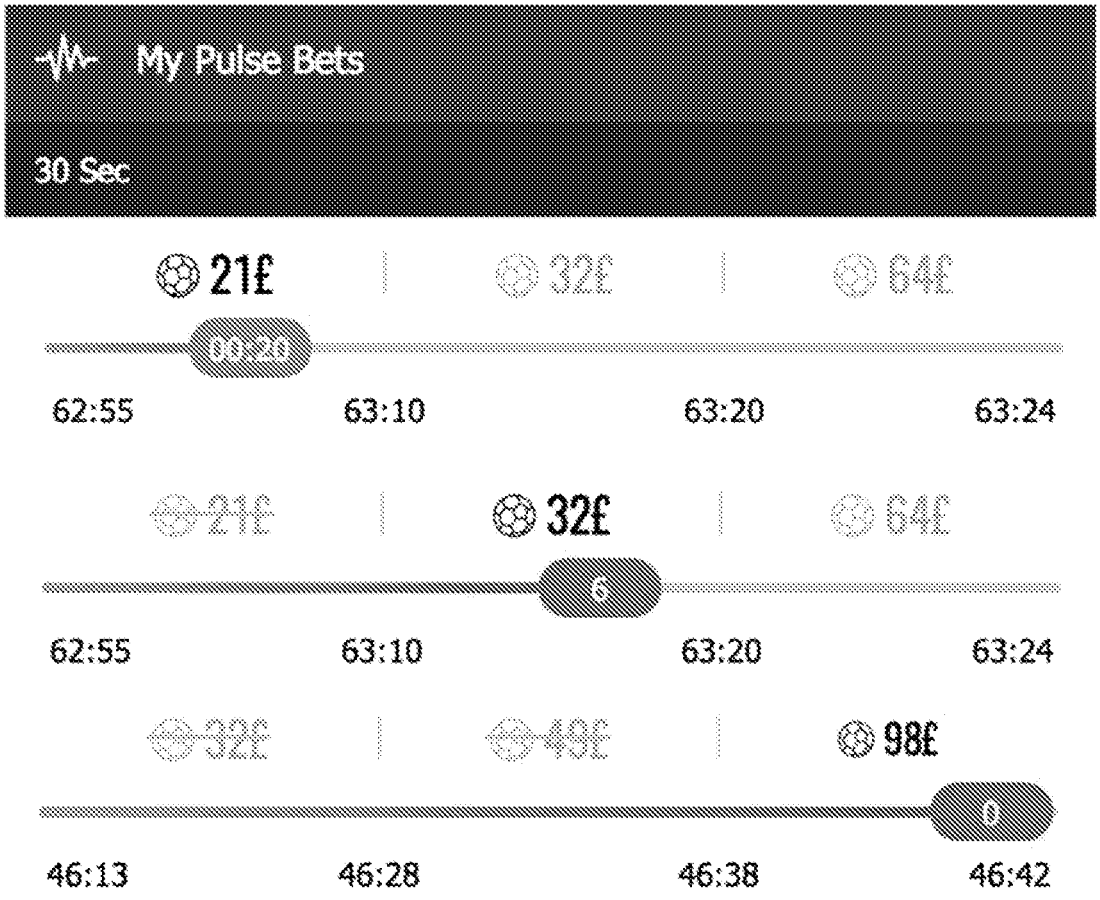
FIG. 3 is a schematic illustration of information provided to the user on the GUI of the present invention.

FIG. 3. is a schematic representation of the GUI showing information to the user comprising the record of the users pulse bets.

Figure 4:
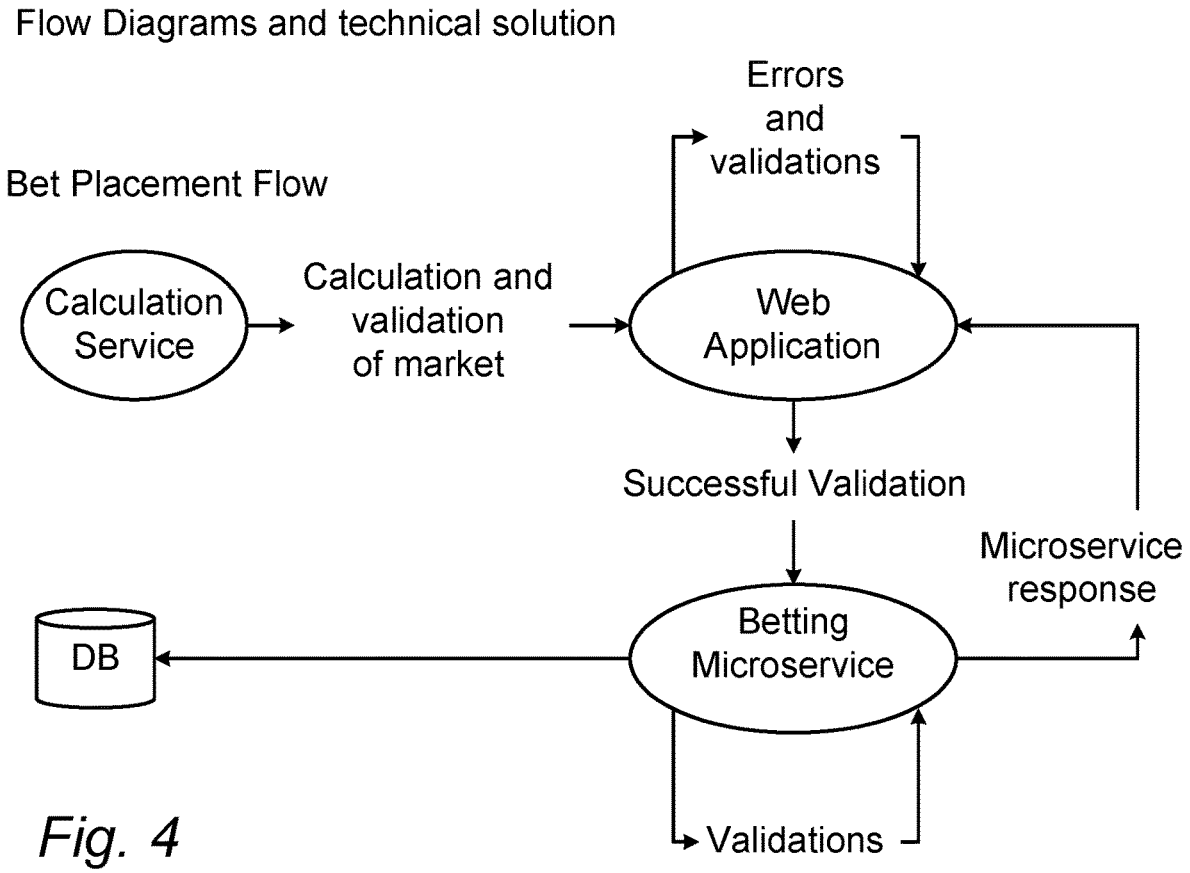
FIG. 4 is a schematic illustration of aspects of the system and method of the present invention.

FIG. 4 is a schematic representation of the Bet Placement Flow:

A calculation service provides bet and odds calculations based on stake event and time segment data to the web application for validation. When validation has occurred the bet is lodged in the Database of the system and the GUI is activated to provide information on the bet and the bet progress.

Figure 5:
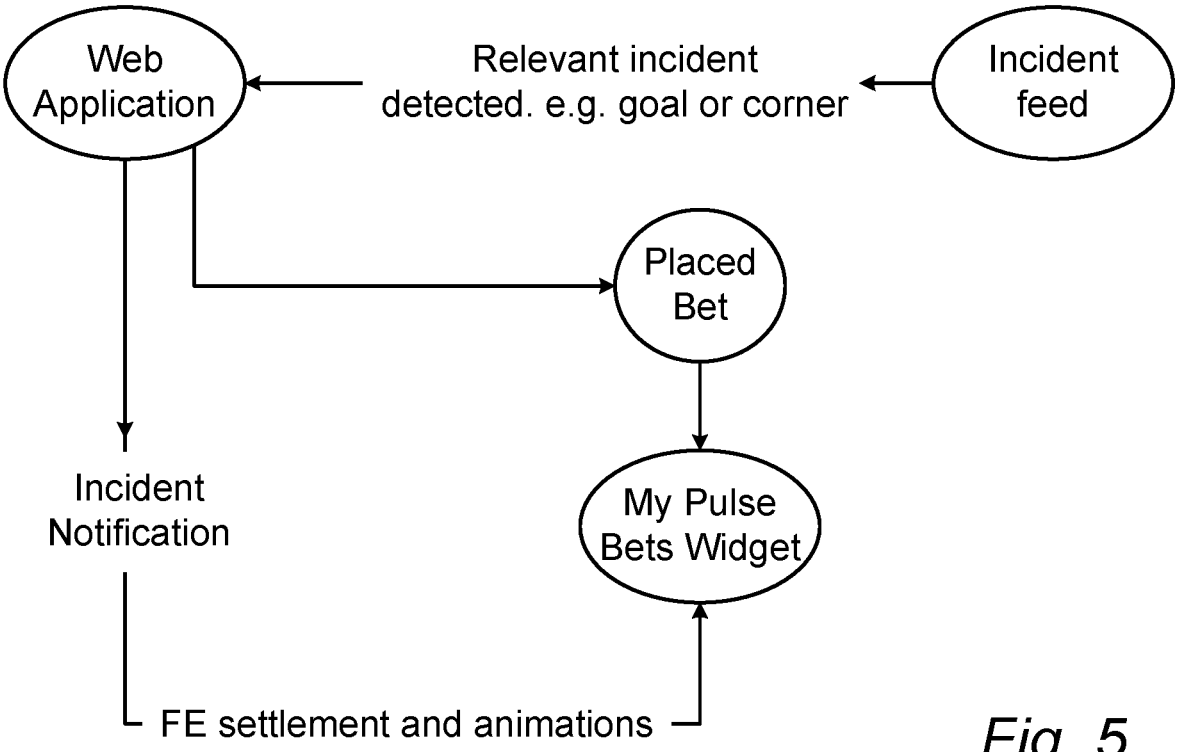
FIG. 5 is a schematic illustration of aspects of the system and method of the present invention.

FIG. 5 is a schematic representation of the Bet Placement Flow.

The web application subscribes to SBTech incident feed.

When relevant incident messages are detected these are passed through the widget that show the bet progress so that the relevant animations are shown in the pulse bet widget Similarly the web application sends placed bet messages to the Open Pulse bets widgets as more bets are placed by users.

An incident feed is a stream of data incidents that is used for calculation and settlement purposes. For example, a goal incident would simultaneously trigger both a change in calculations as well as a settlement flow for relevant bets. The incident feeds are provided by third parties.

An incident feed provides information on the incident which is the subject of a bet (eg. goal scored in a particular time segment). Such incidents are processed through an Open Pulse Bet Widget and reported on the GUI.

The invention claimed is:

1. A system for providing online pulse betting on a game or sports event using an electronic web enabled computing device comprising:

an online betting portal wherein a user selects said game or sports event and a stake using a GUI, and said online betting portal is configured to run a web application; wherein said online betting portal is electronically connected to a communication network;

said GUI displays a return on a bet during a selected time period and displays a countdown timer indicating a defined time period once said game or sports event is selected wherein said user may start said bet anytime during said defined time period;

a calculation module configured for calculating winning amounts, wherein said calculation module calculates said winning amounts based on said user selections; wherein said calculation module also receives inputs from an incident feed wherein said calculation module dynamically calculates the probability of a sport or game incident happening within said time period; and wherein said calculation module is configured to run a mathematical algorithm to calculate said winning amounts;

a database, connected through said communication network with said online betting portal, configured for recording and storing said bet; and said web application configured for receiving said bet and initializing a validation of said bet according to preconfigured parameters;

said incident feed, configured for reporting an occurrence of a defined incident to said calculation module through said communication network and to input said occurrence to said web application;

a settlement engine configured for settling said bet, wherein said web application is electronically connected to said calculation engine through said communication network, and further configured to present a GUI widget displaying said defined incident, said selected predefined time period and, said stake; and wherein said web application is further configured to display on said GUI widget an animation of said defined incident upon receiving a report thereto from said incident feed; and said display of said animations is performed asynchronously from said validation; and said online betting portal is provided by one or more first independent microservices and said settlement engine is provided as one or more second independent settlement microservices; said microservices configured to operate in real time.

2. A betting method for enabling an online user to place a bet concerning a defined incident occurring during a game or sports event by providing a portal for a user to place a bet, of a fixed stake, predicated on said defined incident occurring during a selected predetermined time segment of said game or sports event, and carrying out steps comprising:

a. inputting information concerning said defined incident to a calculation module; wherein said calculating module calculates odds and prize returns for said defined incident to occur during said game or sports event in response to a user request; said prize return is based on said defined incident, said selected predefined time segment, and said fixed stake; using a mathematical algorithm;

b. offering said user said odds by means of a display on a GUI widget, said display comprising an event title, said fixed stake amount, said time segments and a countdown; and wherein said betting method further comprises steps of:

c. displaying animations comprising a countdown animation upon placement of said bet on said GUI widget and a defined incident animation upon occurrence of said defined incident: and d. asynchronously performing said displaying animations and validating said placed bet; and e. providing one or more first independent microservices for placement of said bet and one or more second independent microservices for settling of said bet by means of a settlement engine: said one or more first independent and second independent microservices configured to operate in real time.

3. The system of claim 1, wherein said validation comprises:

a. a defined incident validation of said defined incident, said stake, and said time period, by said calculation module;

b. a bet validation of said bet from said online betting portal; and c. a settlement validation of a bet settlement from said settlement engine, for display on said GUI widget.

4. The system of claim 1, wherein said online betting portal is further configured for the user to select said stake and/or at least one said defined incident.

5. The system of claim 1, wherein said calculation module calculates said winning amounts from said settlement engine.

6. The system of claim 1, wherein said user is provided with means to control duration of said bet (duration being defined as the length of time that the user's stake is at risk).

7. The system of claim 1, wherein said web application runs said validation wherein said preconfigured parameters include prices, and funds, and then electronically communicates with a betting microservice to confirm said bet.

8. The method of claim 2, wherein said validation comprises steps of;

a. validating said defined incident, said fixed stake, and said time segment, by said calculation module;

b. validating said bet by said betting portal; and c. validating bet settlement by said settlement engine, for display on said widget.

9. The method of claim 2, further comprising a step, by said user, of selecting said stake and/or one or more of said defined incidents.

10. The method of claim 2, further comprising a step of providing said calculation for said settlement engine.

11. The method of claim 2, further comprising a step of providing said user with means to control duration of said bet (duration being defined as the length of time that the user's stake is at risk).

12. The method of claim 2, further comprising steps of running said validation wherein said preconfigured parameters include prices and funds and then electronically communicating with a betting microservice to confirm said bet.

* * * * *